United States Patent [19]

Mueller et al.

[11] 3,934,696

[45] Jan. 27, 1976

[54] KEYBOARD TOUCH CONTROL

[75] Inventors: Hans W. Mueller; Richard E. Shattuck, both of Cortland, N.Y.

[73] Assignee: SCM Corporation, New York, N.Y.

[22] Filed: Aug. 30, 1974

[21] Appl. No.: 501,943

[52] U.S. Cl. ..... 197/17; 197/33; 197/98

[51] Int. Cl.[2] ..... B41J 5/26

[58] Field of Search ..... 197/98, 17, 33

[56] References Cited

UNITED STATES PATENTS

| | | | |
|---|---|---|---|
| 2,098,285 | 11/1937 | Gabrielson et al. | 197/33 |
| 2,209,227 | 7/1940 | Helmond | 197/33 |
| 3,204,746 | 9/1965 | Wolowitz | 197/17 X |
| 3,823,806 | 7/1974 | Diamond | 197/17 |

*Primary Examiner*—Anton O. Oechsle

*Attorney, Agent, or Firm*—Stanley J. Klem; Milton M. Wolson, Esq.

[57] ABSTRACT

A keylever touch control mechanism for typewriters includes keylevers mounted on a common pivot which spans the distance between the spaced side frames of the typewriter. The keylevers are supported in their rest position by a plurality of underlying leaf springs. Keylever touch is controlled by the amount of force exerted on the underside of the keylevers by the leaf springs. A spring loaded pivotal bail having rigid extensions underlying the leaf springs pivots into abutment with the springs to vary the tension of the springs. A detented control mechanism is coupled to the bail to pivot the bail extensions into and out of abutment with the leaf springs. When the bail extensions are pivoted into abutment with the leaf springs and a keylever is depressed, the force required to overcome the biasing force of the spring loaded bail extensions to depress a keylever is increased and the keylever touch is correspondingly increased.

When the bail extensions are pivoted out of abutment with the leaf springs and a keylever is depressed, the leaf springs are deflected independent of the bail extensions and therefore the force required to depress a keylever is decreased and the keylever touch is correspondingly decreased.

9 Claims, 7 Drawing Figures

KEYBOARD TOUCH CONTROL

BACKGROUND OF THE INVENTION

This invention relates to typewriters and more particularly to a keylever touch control mechanism for selectably varying the force required to depress a keylever.

Desirable features of touch control mechanisms for typewriters are simplicity, economy, and adjustability. Meeting these requirements has resulted in a variety of mechanisms.

For example, one such touch control mechanism as shown in U.S. Pat. No. 2,098,285 to C. Gabrielson et al, teaches a plurality of keylever coil springs that couple a plurality of keylevers to a common bail. The spring tensions are individually adjustable for each keylever and collectively adjustable for all keylevers by pivoting the bail through a control means.

The many parts in such mechanisms resulted in a complex and costly design.

An improved design as shown in U.S. Pat. No. 3,229,798 to A. Grashoff, included a spring urged common bail underlying all keylevers and selectively biased against the keylevers in a plurality of positions by an adjustable detent. Still another improved design, as shown in U.S. Pat. No. 2,528,450 to J. L. Petz, that incorporated a rigid plate underlying a flat spring tension comb to support and restore the keylevers was introduced.

None of the prior art provides for a simple and inexpensive variable keylever spring force to be exerted between the different rows of keylevers to offset the different lengths of keylevers in the different rows. Furthermore, none of the prior art provides for the engagement of an additional spring system to provide maximum force to depress a keylever and the disengagement of the additional spring system to necessitate minimum force to depress a keylever.

SUMMARY OF THE INVENTION

The present invention provides a keylever touch control mechanism for the keylevers of typewriters. The keylevers are supported on a common pivot and are of different lengths for each row. The touch control mechanism includes a flat flexible spring that extends transverse the typewriter. One edge of the spring is mounted on the keylever segment and the other edge is slotted to define multiple leaf springs of various widths. The leaf springs underlie projecting abutments of each keylever to support and restore the individual keylevers to their rest position. A spring loaded pivotal bail having individual rigid extensions underlying the individual leaf springs may be pivoted into or out of abutment with the leaf springs. A control mechanism includes a control lever pivotally supported on a frame and engageable by a detent mechanism to maintain the control mechanism in any one of two selected positions. The control mechanism is coupled to the bail to pivot the bail into and out of abutment with the leaf springs in response to the selected position of the control lever.

When the control lever is positioned to pivot the bail extensions out of abutment from the leaf springs, the keylever touch is then determined by the amount of force required to depress a keylever against and to deflect a corresponding leaf spring. This amount of force is minimal and is substantially the same among the keylevers in each row due to the various widths of the leaf springs which compensates for the different length keylevers.

When the control lever is positioned to pivot the bail extensions into abutment with the leaf springs, the amount of force required to overcome the normal spring tension of the leaf springs and the spring loaded bail is maximum and the keylever touch is increased.

The individual rigid extensions of the bail are of different lengths for engaging the leaf springs different distances relative to the ends of the leaf springs. The different length rigid extensions pivot the spring loaded bail a different amount for each row of keylevers to substantially equalize the keylever touch for all rows in the maximum touch condition.

Accordingly, an object of the present invention is to provide a keylever touch control mechanism that is of simple construction.

Another object of the present invention is to provide a keylever touch control mechanism that is selectively operative in a plurality of operating positions.

A further object of the present invention is to provide a keylever touch control mechanism where the amount of force exerted by a spring system upon the underside of the different length keylevers is variable between the different rows.

A further object of the present invention is to provide a keylever touch control mechanism where an additional spring system is introduced to the keylever touch to necessitate a maximum amount of force to depress a keylever in one of the adjustable positions.

A further object of the present invention is to provide a keylever touch control mechanism that is operable to completely disengage the additional spring system from the keylever touch to necessitate a minimal amount of force to depress a keylever in the other adjustable position.

Other objects, features, and advantages of the invention will become more apparent from the following description, including appended claims and accompanying drawing in which:

DESCRIPTION OF THE PREFERRED EMBODIMENT

Figure 1:
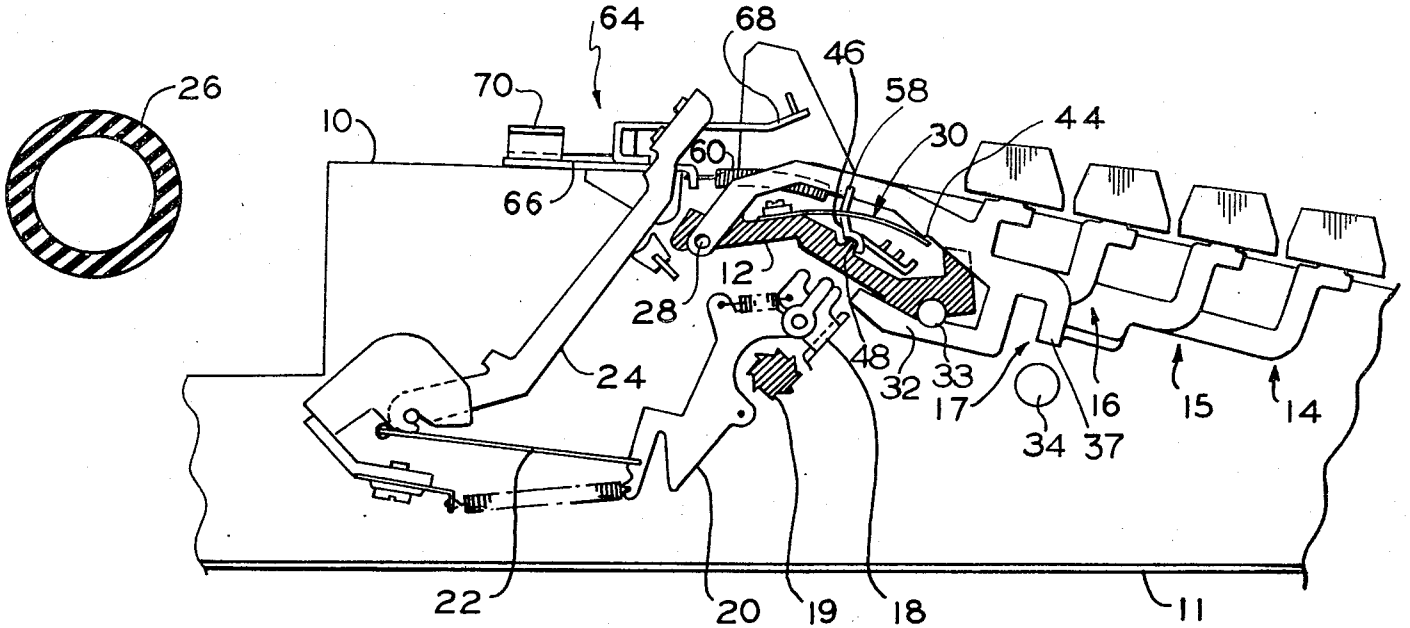
FIG. 1 is a left side elevation view of a typewriter showing the present invention.

Referring now to FIG. 1, a portion of a typewriter is shown having a pair of side frames 10 supported on a base 11. Spanning side frames 10, a keylever segment 12 provides the support for a plurality of keylevers 14, 15, 16, and 17 at a common pivot 28. When depressed, keylevers 14, 15, 16, and 17 engage a pivotal pawl 18 that pivots into the path of a rotating power roll 19. An actuator 20 that supports pawl 18 is urged to pivot and pull a connecting link 22 forward to place a typebar 24 in flight with sufficient momentum to strike a platen 26 with sufficient force to imprint a character on a printing medium placed therebetween.

Keylevers 14, 15, 16, and 17 are pivotally supported at one end on common pivot 28 that is supported by keylever segment 12. The keylevers are limited in their upward movement by a keylever extension 32 abutting an up-stop 33 and in their downward movement by extensions 29, 31, 35, and 37 abutting a down stop 34. The other ends of keylevers 14, 15, 16, and 17 terminate in four forward extensions 21, 23, 25, and 27 respectively of different lengths to define four rows of keylevers.

Figure 3:
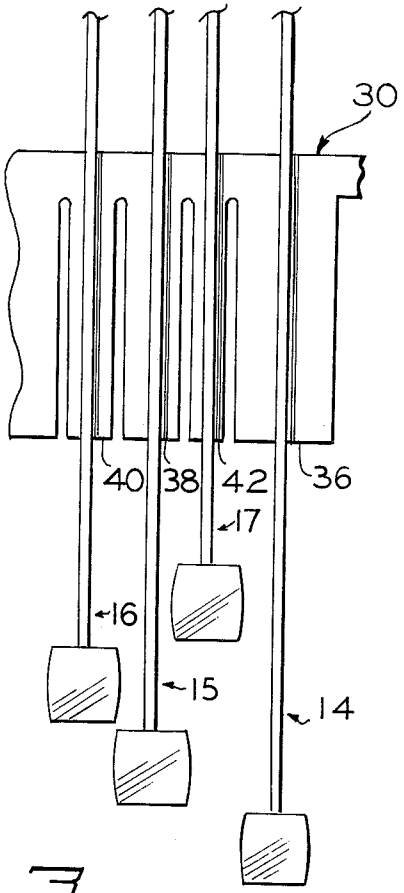
FIG. 3 is a plan view showing several keylevers and their relationship with the leaf springs.

To restore the keylevers to their rest positions and equalize the different mechanical advantage of the different length keylevers, a flat spring 30 is utilized. Flat spring 30 underlies keylevers 14, 15, 16, and 17. Spring 30 is of single piece construction having one side fixed along the length of keylever segment 12 and the other side slotted towards the fixed side to define a series of different width leaf springs 36, 38, 40, and 42. Leaf springs 36, 38, 40, and 42 underlie and abut an abutment 44 of keylevers 14, 15, 16, and 17 to support the keylevers in their rest position and to restore the keylevers to rest position when they are depressed during operation. Leaf springs 36, 38, 40, and 42 underlie keylevers 14, 15, 16, and 17 in relation to the length of the keylevers. For example, the widest leaf springs 36 having the greatest bias tension underlie keylevers 14 that have the longest forward extensions and greatest mechanical advantage, best shown in FIGS. 3 and 7. The next widest leaf springs 38 having less tension underlie keylevers 15 that have shorter forward extensions than keylevers 14 and less mechanical advantage, best shown in FIGS. 3 and 6. The next widest leaf springs 38 having still less bias tension underlie keylevers 16 that have shorter forward extensions than keylevers 15 and still less mechanical advantage, best shown in FIGS. 3 and 5. The narrowest leaf springs 42 capable of exerting the least bias tension underlie keylevers 17 that have the shortest forward extensions and the least mechanical advantage, best shown in FIGS. 3 and 4. Therefore, the amount of force required to depress keylevers 14, 15, 16, and 17 is substantially equalized as a result of the proper selection and relationship of springs 36, 38, 40, and 42 to keylevers 14, 15, 16, and 17.

The amount of force required to depress any keylever against a corresponding leaf spring is directly proportional to the length of the keylever measured from pivot 28 to the end of the keylever. In other words, the mechanical advantage of keylever 17, the shortest keylever, is less than the mechanical advantage of keylever 14, the longest keylever.

Figure 2:
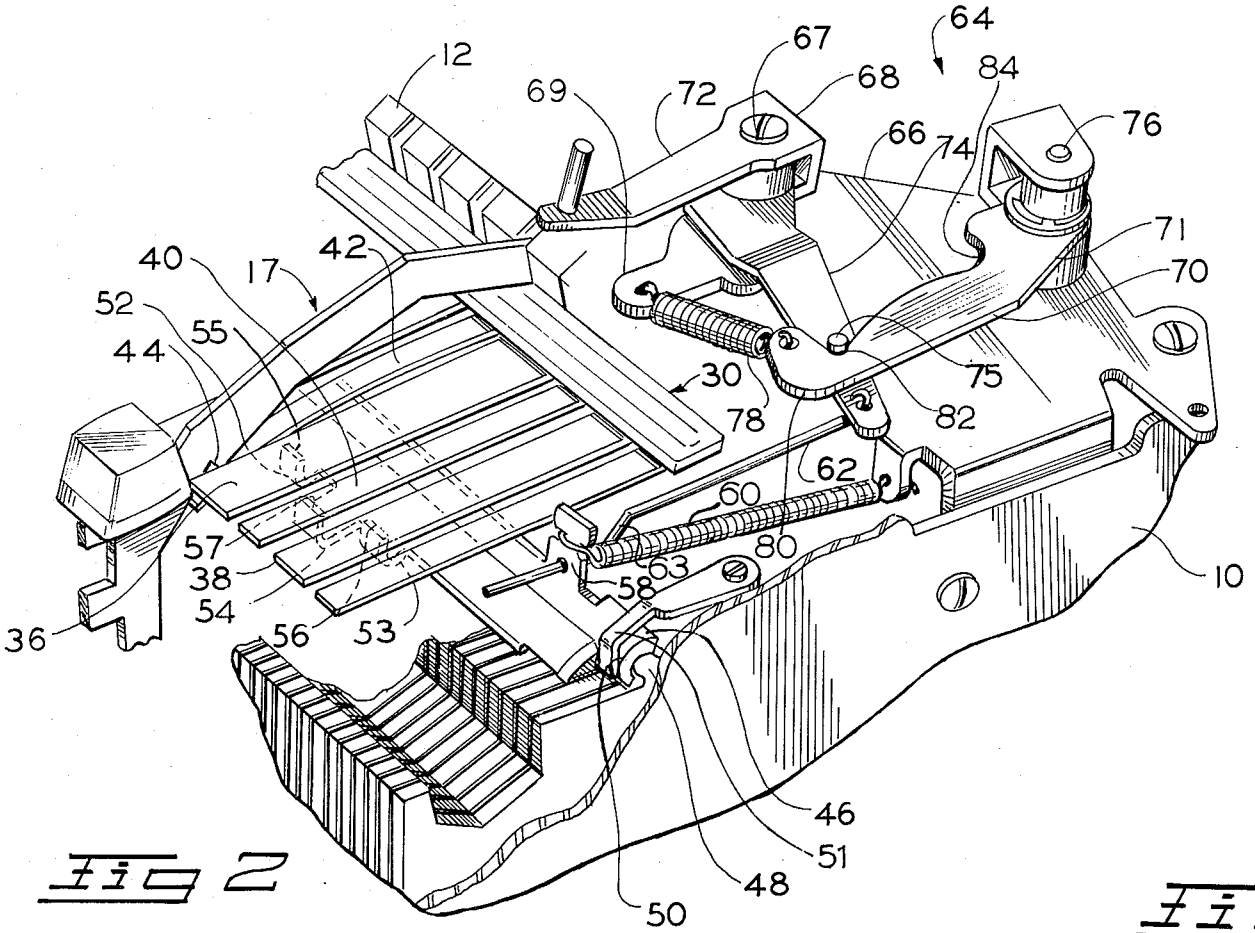
FIG. 2 is a perspective view of the control mechanism of the present invention.
Figure 4:
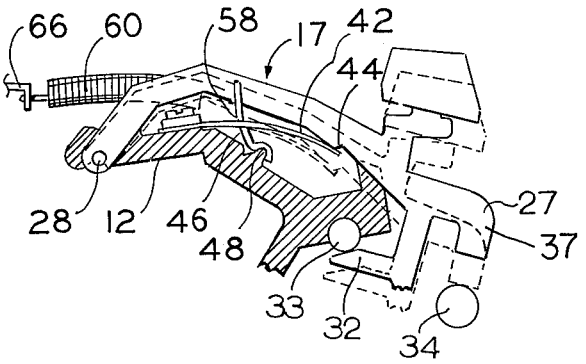
FIG. 4 is a sectional side elevation view showing the keylever of row 1 in a rest and depressed position and its relationship with the touch control mechanism which is ineffective due to there being no underlying rigid extensions in alignment with the first row of keylevers.
Figure 5:
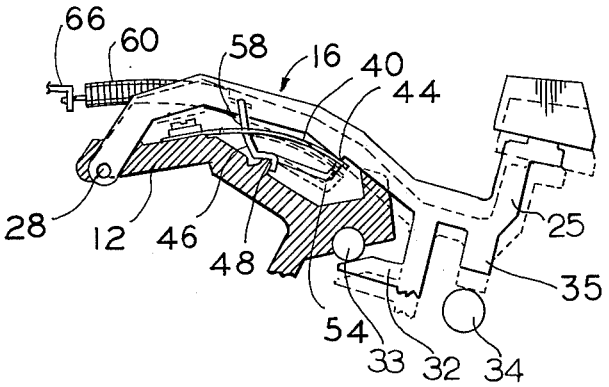
FIG. 5 is a sectional side elevation view showing the keylever of row 2 in a rest and depressed position and its relationship with the touch control mechanism in the effective position.
Figure 6:
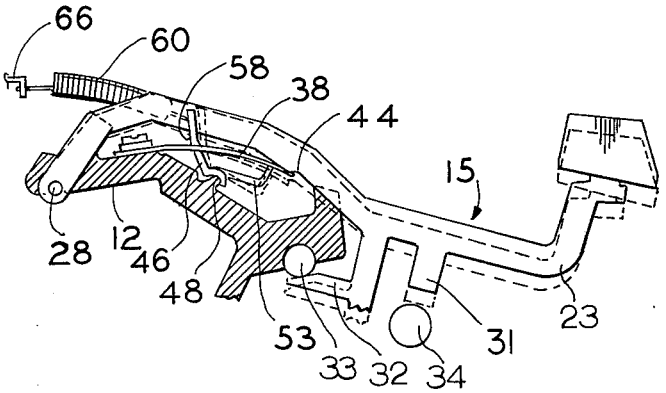
FIG. 6 is a sectional side elevation view showing the keylever of row 3 in a rest and depressed position and its relationship with the touch control mechanism in the effective position.

A bail 46 is pivotally suported about a fulcrum 48 formed on and extending along the length of keylever segment 12. Bail 46 is an elongated member having its ends 50 formed to cooperate with fulcrum 48 of keylever segment 12, best shown in FIG. 2. A retainer 51 overlies bail ends 50 and maintains the cooperation between bail 46 and fulcrum 48. Spaced along the length of one edge of bail 46 are a series of extensions 52, 53, and 54 that terminate in upstanding tabs 55, 56, and 57. Extensions 52, 53, and 54 are of different lengths and extension tabs 55, 56, and 57 are in vertical alignment for engagement with the lever surface of leaf springs 36, 38, and 40 when bail 46 is in an effective operative position. For example, tab 55 of the shortest extension 52 is in alignment with the widest leaf spring 36 and shown in FIG. 7. Tab 56 of intermediate length extension 53 is in alignment with the next widest spring 38 as shown in FIG. 6. Tab 57 of the longest extension 54 is in alignment with the next widest leaf spring 40 as shown in FIG. 5. The narrowest leaf spring 42 as shown in FIG. 4 does not cooperate with any extension of bail 12 and hence, is not affected by the additional spring system of the touch control mechanism. An upstanding arm 58 on one end of bail 46 as shown in FIG. 2 carries the free end of a spring 60 so as to bias bail 46 and therefore upstanding tabs 55, 56, and 57 into an abutting relationship with leaf springs 36, 38, and 40 when bail 46 is in its operative position. A rod link 62 extending from an arm 74 of a control mechanism 64 engages bail arm 58 to detain bail 46 in an inoperative position. Rod link 62 is formed to include an inclined abutment 63 which is positioned adjacent to and behind bail arm 58. Therefore, forward movement of arm 74 will result in a corresponding movement of rod link 62 to overcome the bias effect of spring 60 on bail 46. Inclined abutment 63 will simultaneously engage arm 58 and urge it forward to place bail 46 in an inoperative position.

Control mechanism 64, best shown in FIG. 2, selectably controls the positioning of bail 46 and includes a horizontal platform 66, a control lever 68 and a detent member 70. Platform 66 is fixed to end frame 10 and provides support for control mechanism 64.

Control lever 68 is pivotally supported about a pivot stud 67 located on a platform 66 and includes a pair of angularly disposed horizontal arms 72 and 74 that are fixed relative to one another. Arm 72 extends forward and arm 74 extends laterally and includes an upstanding detent pin member 75 projecting therefrom.

Detent member 70 is pivotally supported on platform 66 at one end 71 about a pivot stud 76. Spring 78 extends and is fixed between an opposite end 80 of detent member 70 and an ear 69 of platform 66 serves to bias detent member 70 in a counterclockwise direction. Detent member 70 extends above and crosswise of arm 74 of control lever 68 whereby either holding recess 82 or 84 formed in the edge face of detent member 70 is biased into selective retaining engagement with upstanding detent pin member 75 of control lever 68.

In operation, the touch control mechanism is normally disposed in an ineffective position to produce a minimum key touch. An ineffective position of the touch control mechanism prevails when control lever 68 is pivotally positioned clockwise by manually moving lever 72 laterally to the left until upstanding member detent pin 75 is engaged in holding recess 82 of detent member 70. Control lever arm 74 is now at its most forward position and link 62 is urged forward which, in turn, urges bail 46 to pivot downward thereby positioning bail extensions 52, 53, and 54 away from leaf springs 36, 38, and 40.

If a keylever 14, 15, 16 or 17 is now depressed, the force required to depress the keylever is a minimal force required to overcome only the spring tension of the opposed leaf springs 36, 38, 40, and 42.

If an operatively effective position of the touch control mechanism is desired, control lever 68 is pivotally positioned counterclockwise by manually moving lever 72 laterally to the right until upstanding detent pin member 75 is engaged in holding recess 84 of detent member 70. Control lever arm 74 is now at its most rearward position and rod link 62 is carried rearward, thus allowing spring 60 to urge bail 46 to pivot upward, thereby positioning bail extensions 52, 53, and 54 in abutment with leaf springs 36, 38, and 40.

If a keylever 14, 15, and 16 is now depressed, the force required to depress the keylever is increased. When keylever 14, 15, or 16 is now depressed, the force required to depress the keylever must be increased to overcome combination of the spring tension of leaf springs 36, 38, and 40, and the spring bias of bail spring 60 which maintains the abutting relationship of extension tabs 55, 56, and 57 with leaf springs 36, 38, and 40.

Moreover, the amount of force required to overcome the biasing effect of bail spring 60 is directed about fulcrum 48 and is predicated by the distance from bail fulcrum 48 to the predetermined point at which a bail tab abuts a leaf spring or what hereafter will be referred to as the mechanical advantage of bail extension. The greater the mechanical advantage of bail extension, then less force is required to pivot ball 46.

Figure 7:
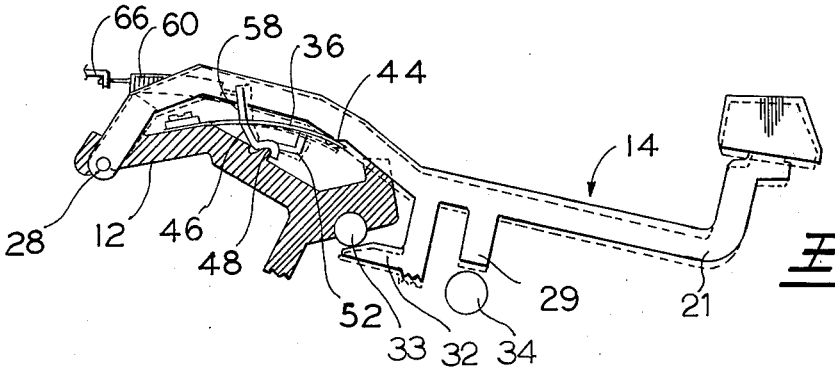
FIG. 7 is a sectional side elevation view showing the keylever of row 4 in a rest and depressed position and its relationship with the touch control mechanism in the effective position.

More specifically, as shown in FIG. 7, leaf springs 36 of the fourth row cooperate with bail extensions 52 that have the least mechanical advantage thereby effecting a necessary increase in force required to pivot bail 46 when depressing a keylever in the fourth row. As shown in FIG. 6, leaf springs 38 of the third row cooperate with bail extensions 53. Bail extensions 53 have a greater mechanical advantage than bail extensions 52 thereby requiring a necessary force to depress a keylever in the third row that is substantially equal to the force required to depress a keylever in the fourth row. As shown in FIG. 5, leaf springs of the second row cooperate with bail extensions 54. Bail extensions 54 have a greater mechanical advantage than bail extensions 53 thereby requiring a necessary force to depress a keylever in the second row that is substantially equal to the force required to depress a keylever in the third row.

While the foregoing description has shown and described the fundamental novel features as applied to a preferred embodiment, it will be understood by those skilled in the art that modifications embodied in various forms may be made without departing from the spirit and scope of the invention.

What is claimed is:

1. A frame supported keylever touch control mechanism for typewriters having a plurality of keylevers, the touch control mechanism comprising:

holding means supported on the frame and movable relative to said frame;

control means engaged by said holding means for maintaining a selectable position of said control means;

a plurality of leaf springs underlying and upwardly biasing the keylevers;

a shiftable bail supported on the frame and movable by said control means between an inoperative position and an operative position, the shiftable bail in the inoperative position being spaced from the keylever leaf springs to avoid affecting the touch of the keylevers and in the operative position being disposed in contact with said leaf springs; and a touch control spring connected to the shiftable bail to cause the bail to add to the upward bias of the leaf springs to effect a heavier touch on the keylevers when the shiftable bail is in the operative position.

2. A mechanism as defined in claim 1 wherein said shiftable bail includes extensions extending therefrom and underlying said keylever leaf springs for abutting the keylever leaf springs when said shiftable bail is in the operative position thereby affecting the touch of the keylevers.

3. A mechanism as defined in claim 2 wherein said shiftable bail extensions are of different lengths for contacting the keylever leaf springs at different predetermined points along said keylever leaf springs for equalizing the keylever touch of the different rows.

4. A mechanism as defined in claim 3 wherein a keylever leaf spring for a keylever in a first row of keylevers engages an extension of said shiftable bail at a first point along said keylever leaf spring when said shiftable bail is in said operative position and said shiftable bail includes a pivot means spaced from said first point and said shiftable bail actuates said touch control spring to provide a predetermined force required to depress a keylever in said first row of keylevers.

5. A mechanism as defined in claim 4 wherein a second keylever leaf spring for a keylever in a second row of keylevers shorter than said first row of keylevers engages a second extension of said shiftable bail at a second point along said second keylever leaf spring and wherein said second point is spaced nearer said shiftable bail pivot means than said first point to provide a predetermined force required to depress a keylever in said second row of shorter keylevers that is substantially equal to said predetermined force required to depress a keylever in said first row of longer keylevers.

6. A mechanism as defined in claim 5 wherein a third keylever leaf spring for a keylever in a third row of keylevers shorter than said second row keylevers engages a third extension of said shiftable bail at a third point along said keylever leaf spring wherein said third point is spaced nearer said shiftable bail pivot means than said second point to provide a predetermined force required to depress a keylever in said third row of shorter keylevers that is substantially equal to said predetermined force required to depress a keylever in said second row of longer keylevers.

7. A mechanism as defined in claim 1 wherein said control means further includes a means for detaining said shiftable bail in said inoperative position.

8. A mechanism as defined in claim 7 wherein said touch control spring cooperates with said control means for biasing said shiftable bail to said operative position when said detaining means is displaced from said shiftable bail.

9. A frame mounted keylever touch control mechanism for typewriters having a plurality of keylevers, the touch control mechanism comprising:

a two position detent lever pivotally supported on the frame and movable relative to the frame;

a control lever engageable by said detent lever for maintaining a selectable position of said control lever;

a plurality of variable width leaf springs underlying and upwardly biasing the keylevers;

a shiftable bail pivotally supported on the frame, the bail having extensions extending therefrom at different lengths underlying said keylever leaf springs, and movable by said control lever from an inoperative position spaced from said keylever leaf springs to avoid affecting the touch of the keylevers to an operative position wherein said bail extension abut the keylever leaf springs thereby affecting the touch of the keylevers.

a touch control spring connected to the shiftable bail to cause the bail to add to the upward bias of the leaf springs to effect a heavier touch on the keylevers when the shiftable bail is in the operative position.

* * * * *

UNITED STATES PATENT OFFICE

CERTIFICATE OF CORRECTION

Patent No. 3,934,696 Dated January 27, 1976

Inventor(s) Hans W. Mueller, Richard E. Shattuck

It is certified that error appears in the above-identified patent and that said Letters Patent are hereby corrected as shown below:

Claim 5, line 6, delete "nearer" and substitute --farther from--.

Claim 6, line 6, delete "nearer" and substitute --farther from--.

Signed and Sealed this

Seventh Day of June 1977

[SEAL]

*Attest:*

RUTH C. MASON
*Attesting Officer*

C. MARSHALL DANN
*Commissioner of Patents and Trademarks*